US010962246B2

(12) United States Patent
Bromley

(10) Patent No.: US 10,962,246 B2
(45) Date of Patent: Mar. 30, 2021

(54) CLEAN AIR APPARATUS AND METHOD FOR DISCHARGING CLEAN AIR TOWARDS A TARGET CLEAN AREA IN THE FORM OF AN AIR CURTAIN

(71) Applicant: HOWORTH AIR TECHNOLOGY LIMITED, Farnworth (GB)

(72) Inventor: Graham Bromley, Farnworth (GB)

(73) Assignee: HOWORTH AIR TECHNOLOGY LIMITED, Farnworth (GB)

( * ) Notice: Subject to any disclaimer, the term of this patent is extended or adjusted under 35 U.S.C. 154(b) by 747 days.

(21) Appl. No.: 14/388,384

(22) PCT Filed: Mar. 20, 2013

(86) PCT No.: PCT/GB2013/050724
§ 371 (c)(1),
(2) Date: Sep. 26, 2014

(87) PCT Pub. No.: WO2013/144582
PCT Pub. Date: Oct. 3, 2013

(65) Prior Publication Data

US 2015/0072609 A1 Mar. 12, 2015

(30) Foreign Application Priority Data

Mar. 29, 2012 (GB) ..... 1205557.0

(51) Int. Cl.
*F24F 9/00* (2006.01)
*A61G 13/10* (2006.01)
(Continued)

(52) U.S. Cl.
CPC ..... *F24F 9/00* (2013.01); *A61G 13/108* (2013.01); *F24F 3/1607* (2013.01); *F24F 2013/0612* (2013.01); *F24F 2221/28* (2013.01)

(58) Field of Classification Search
CPC ..... F24F 9/00; F24F 2221/28; A61G 13/108
(Continued)

(56) References Cited

U.S. PATENT DOCUMENTS 2,052,869 A * 9/1936 Coanda ..... D02G 1/161 131/211
3,049,984 A * 8/1962 Boysen ..... F24F 13/1406 454/192
(Continued)

FOREIGN PATENT DOCUMENTS

DE 1779047 B2 3/1972
DE 3331299 A1 3/1985
(Continued)

OTHER PUBLICATIONS

Search Report of GB1205557.0 dated Jul. 20, 2012 in English.
(Continued)

*Primary Examiner* — Kenneth J Hansen
*Assistant Examiner* — Phillip Decker
(74) *Attorney, Agent, or Firm* — Fitch, Even, Tabin & Flannery, LLP

(57) ABSTRACT

A clean air apparatus includes a fan and a filter for producing a flow of clean air and for discharging the clean air from an outlet and towards a target clean area. The apparatus includes a Coanda effect device disposed at least adjacent the clean air means, which is arranged, in use, to induce a Coanda effect upon the flow of clean air. The apparatus includes guide means for guiding the clean air towards a target clean area in the form of an air curtain. A method for discharging clean air towards a target clean area in the form of an air curtain includes inducing a Coanda effect upon the flow of clean air using the Coanda effect device; and guiding
(Continued)

the discharged clean air, downstream of the Coanda effect device, towards a target clean area in the form of an air curtain.

18 Claims, 5 Drawing Sheets

(51) Int. Cl.
*F24F 3/16* (2021.01)
*F24F 13/06* (2006.01)

(58) Field of Classification Search
USPC ..... 454/187; 239/DIG. 7
See application file for complete search history.

(56) References Cited

U.S. PATENT DOCUMENTS 3,157,105 A * 11/1964 Tamm ..... F24F 13/06 454/192
3,232,204 A * 2/1966 Gygax ..... F24F 9/00 454/192
3,255,686 A * 6/1966 Larson ..... F24F 9/00 454/188
3,294,006 A * 12/1966 Berner ..... F24F 9/00 454/191
3,380,369 A * 4/1968 Allander ..... A61G 13/108 128/205.26
3,394,755 A * 7/1968 Morrison ..... F24F 9/00 165/103
3,511,162 A 5/1970 Truhan
3,726,203 A * 4/1973 Lindestrom ..... F24F 9/00 454/189
3,768,394 A * 10/1973 Powlesland ..... F24F 13/26 454/188
4,009,647 A * 3/1977 Howorth ..... A61G 13/108 128/897
4,094,232 A 6/1978 Howarth
4,152,094 A * 5/1979 Honda ..... F04D 29/164 415/119
4,266,722 A * 5/1981 Nawa ..... F24F 13/072 239/590.5
4,466,254 A * 8/1984 Karashima ..... A47F 3/0447 454/193
4,534,277 A 8/1985 Gillmor
4,607,565 A 8/1986 Sugawara
4,776,263 A 10/1988 Lokander
5,290,331 A * 3/1994 Miles ..... A61G 13/108 55/321
5,340,358 A 8/1994 Halupczok
5,435,489 A * 7/1995 Jenkins ..... F02K 1/28 239/265.17
5,609,305 A * 3/1997 Webb ..... B05B 1/005 239/590.3
5,830,058 A * 11/1998 Røsjø ..... A61G 13/108 454/187
5,921,104 A * 7/1999 Chang ..... F24F 9/00 62/407
6,110,244 A * 8/2000 Wood ..... F24F 3/1607 454/189
6,146,267 A * 11/2000 Beudon ..... F24F 9/00 454/188
6,336,451 B1 * 1/2002 Rohl-Hager ..... B08B 15/02 126/299 D
6,902,474 B2 * 6/2005 Gehring ..... B60H 1/3414 454/152
7,478,993 B2 * 1/2009 Hong ..... F04D 29/547 415/211.2
7,563,322 B2 * 7/2009 Loth ..... B05C 11/06 118/63
2005/0044653 A1 * 3/2005 Wakao ..... B08B 3/02 15/302
2009/0061754 A1 * 3/2009 Hlavka ..... B64D 13/00 454/152
2009/0294084 A1 * 12/2009 Duck ..... B65H 23/24 162/202
2010/0120349 A1 * 5/2010 Kristensson ..... A61G 13/108 454/187
2010/0280436 A1 * 11/2010 Self ..... A61G 13/108 604/23
2011/0151767 A1 * 6/2011 Rosjo ..... A61G 13/108 454/254
2012/0034108 A1 * 2/2012 Wallace ..... F04D 25/08 417/313

FOREIGN PATENT DOCUMENTS

EP 0535550 A 4/1993
EP 0816773 B1 1/1998
EP 0710803 B1 4/1999
EP 1707892 A1 10/2006
GB 1424988 A 2/1976
GB 2216646 B 10/1989
JP S6166042 A 4/1986
JP S62178836 A 8/1987
JP 62-268939 A 11/1987
JP 63209725 A 8/1988
JP 03271683 A * 12/1991
JP H11325573 A 11/1999
JP 2011-257011 A 12/2011
WO WO 2008058334 A1 * 5/2008 ..... F15D 1/04

OTHER PUBLICATIONS

Search Report of Singapore Appln. 11201406159U dated Sep. 25, 2015 in English.
Examination Report of Indian Application No. 7917/CHENP/2014 dated Mar. 27, 2019 with English translation.

* cited by examiner

CLEAN AIR APPARATUS AND METHOD FOR DISCHARGING CLEAN AIR TOWARDS A TARGET CLEAN AREA IN THE FORM OF AN AIR CURTAIN

The invention relates to clean air apparatuses, and particularly, although not exclusively, to clean air apparatuses which can be used in operating theatres, and in manufacturing plants of any product requiring a "clean room" environment, such as pharmaceutical products or semiconductors.

In the manufacture of many products, such as pharmaceuticals and semiconductors, there is a need to maintain the working environment as clean as possible in order to reduce the possibility of the product becoming contaminated. Furthermore, in a hospital operating theatre, it is important that the area surrounding at least the operating table supporting the patient is kept as sterile as possible in order to reduce the risk of infection.

Clean air systems which harness the so-called Coanda effect in order to create a jet or curtain of clean air over a designated target clean area are known. The Coanda effect is the tendency of a fluid jet to be attracted to a nearby surface, and is caused by the entrainment of ambient fluid around the fluid jet. When a nearby surface does not allow the surrounding fluid to be pulled inwards towards the jet (i.e. to be entrained), the jet moves towards the surface instead.

However, a problem with known Coanda-based clean air systems is that they are unable to efficiently direct the clean air Coanda jet towards the target clean air zone, such as an operating table or pharmaceutical or semiconductor manufacturing area. This results in the clean (i.e. filtered) air mixing with surrounding unclean (i.e. unfiltered) air, which is then entrained into the target clean air zone, thereby causing infection and contamination.

Accordingly, there is a need to provide an improved clean air apparatus.

According to a first aspect of the invention, there is provided a clean air apparatus comprising clean air means for producing a flow of clean air and for discharging the clean air from an outlet and towards a target clean area, a Coanda effect device disposed at least adjacent the clean air means and arranged, in use, to induce a Coanda effect upon the flow of clean air, and guide means for guiding the clean air towards a target clean area in the form of an air curtain.

In a second aspect, there is provided a method for discharging clean air towards a target clean area in the form of an air curtain, the method comprising:

(i) creating a flow of clean air by clean air means;
(ii) discharging the flow of clean air through an outlet;
(iii) inducing a Coanda effect upon the flow of clean air using a Coanda effect device disposed at least adjacent the clean air means; and
(iv) guiding the discharged clean air towards a target clean area in the form of an air curtain.

Advantageously, the provision of the guide means ensures that the Coanda air is more efficiently and accurately directed in the form of an air curtain towards the target clean area. Preferably, the guide means is adapted to create an air curtain around the periphery of the clean area. The outer periphery of the target clean area preferably comprises air which is travelling at an increased speed compared to that of the clean air inside the target clean area. As such, the air curtain provides improved protection to the clean (i.e. filtered) air present in the target clean area. This is achieved by preventing the clean air in the clean area from mixing with unclean surrounding air, which may be unfiltered, thereby avoiding the risk of contamination.

In one embodiment, the clean air apparatus may be used in a hospital operating theatre in order to maintain sterile conditions. For example, the apparatus may be incorporated into a hospital's ultra clean ventilation (UCV) system, which may be installed in an operating theatre. In this embodiment, the clean air means may comprise or be part of the UCV system.

Thus, in a third aspect, there is provided a hospital ultra clean ventilation (UCV) system comprising the clean air apparatus according to the first aspect.

The UCV system may be installed in a hospital operating theatre. The clean air apparatus may be disposed above an operating table on which a patient undergoing an operation may be supported. Advantageously, the inventors have shown that the apparatus of the invention can be used in a canopy without any partial walls present such that it can be installed at a high level. Accordingly, the creation of the air curtain by the apparatus of the invention replaces screens or partial walls, which would otherwise be required, for example in an operating theatre.

In use, the apparatus may be installed at a minimum height of about 2300 mm, 2500 mm or 2700 mm above the target clean area, which may be an operating table. The apparatus may be installed, in use, at a maximum height of about 2900 mm above the target clean area. However, it will be appreciated that the height at which the apparatus is installed is dependent on the specific application and environment.

Alternatively, in another embodiment, the clean air apparatus may be used in a manufacturing plant of any product requiring a "clean room" environment, such as the manufacture of a pharmaceutical product or a semiconductor.

Hence, in a fourth aspect, there is provided a pharmaceutical manufacturing plant ventilation system comprising the clean air apparatus according to the first aspect.

In a fifth aspect, there is provided a semiconductor manufacturing plant ventilation system comprising the clean air apparatus according to the first aspect.

The Coanda effect device is capable of inducing the Coanda effect upon the flow of clean air. It will be appreciated that a "Coanda effect" arises when a tangential jet of air moves passed a convex surface. The jet of air exhibits strong attachment to the surface and is deflected from the tangential direction to follow the profile of the curved surface. By using the Coanda effect device in conjunction with the clean air apparatus of the invention, the deflected jet of air entrains a portion of the adjacent clean air and produces an outwardly-directed flow of air out of the outlet which can be controlled and directed by the guide means as an air curtain towards at least the periphery of the target clean area. Any potentially contaminating or unclean air must therefore overcome the outward flow of clean air in order to reach the target clean area, and the likelihood of contamination of the clean area by unfiltered air is thus significantly reduced or even abolished. If the tangential jet of air produced by the Coanda effect device is also clean air, then the effect is to enlarge then target clean area.

In one embodiment, at least a part of the periphery of the outlet may be provided with the Coanda effect device. In a preferred embodiment, however, substantially all of the periphery of the outlet is provided with the Coanda effect device.

The clean air means (which in some embodiments may be the UCV) preferably comprises an air filter through which unclean air may be passed in order to create the flow of clean air. The filter may be a High-Efficiency Particulate Air (HEPA) filter bank, but the skilled person will appreciate that other filters are available and could be used. The clean air means (e.g. a UCV) may therefore comprise a fan which blows the unclean air through the filter to create the flow of clean air.

The clean air means may comprise a peripheral wall extending away from the periphery of the outlet, and the Coanda effect device may be disposed at or towards a distal edge thereof. The requirement for the peripheral wall may be negated to some extent by the use of the Coanda effect device. The outlet may comprise a diffuser, which may be perforated, and through which the flow of clean air is discharged towards the target clean area. It will be appreciated that, in some embodiments, the diffuser may also be part of the UCV system.

The Coanda effect device may comprise a profiled convex surface along which the flow of clean air passes. The profiled convex surface may comprise or form at least a quarter portion of the circumference of a circle. Alternatively, the profiled convex surface may comprise or form at least half, or substantially all, of the circumference of a circle. For example, the profiled convex surface may comprise a tube or pipe attached to the clean air means.

The Coanda effect device may be disposed so that, in use, it is at least partially below the outlet, thereby presenting the profiled convex surface to the flow of clean air discharged from the outlet.

The guide means may comprise a substantially planar guide vane. The guide vane may be at least 2 cm in length. However, the guide vane is preferably at least 5 cm, at least 10 cm or at least 15 cm in length. Most preferably, the guide vane is between about 15-20 cm long.

Preferably, the guide means extends in a direction from an inner or internal side of the Coanda effect device to an outer or external side thereof.

In an embodiment where the clean air apparatus is secured to a ceiling, it may be arranged such that the flow of clean air is discharged substantially downwards towards the target clean area, and preferably a periphery thereof.

Thus, in use, the guide means may extend substantially downwards. The guide means may extend tangentially away from the profiled convex surface at an angle of between about 1° and 30°, or between about 2° and 25°, or between about 5° and 20°, or between about 7° and 15°, with respect to a vertical plane of the Coanda effect device, and preferably the profiled convex surface thereof. Preferably, however, the guide means extends at an angle of between about 8° and 12° with respect to the vertical plane of the Coanda effect device.

In one embodiment of the apparatus, the Coanda effect device may be an internal blowing device, in which the Coanda air is blown towards an internal side of the apparatus or canopy (see FIG. 4).

However, in another embodiment, the Coanda effect device may be an external blowing device, in which the Coanda air is blown towards an external side of the apparatus or canopy (see FIG. 6). Advantageously, external blowing can overcome the need for a HEPA filter, which would otherwise be required for internal blowing.

In some embodiments, the Coanda effect device may be a combined internal and an external blowing device in which Coanda air is blown towards both the internal and external sides of the canopy.

In another embodiment, the Coanda effect device may be capable of creating a passive Coanda effect. The term "Coanda effect" can mean that no fan is required, and that the air flow is created externally, for example by the UCV.

In yet another embodiment, however, the Coanda effect device may be capable of creating an active Coanda. The term "active Coanda effect" can mean positively generating a second flow of clean air via a separate pressure source, such as a fan. In such an embodiment, the clean air means (e.g. the UCV) is taken to be the first flow of clean air. In this embodiment, the Coanda effect device may be arranged to feed the second flow of clean air, which is passed over the profiled convex surface, such that it entrains the first flow of clean air (i.e. from the UCV), wherein the two flows of clean air are collectively discharged around the periphery of the target clean air area. The guide means may therefore guide the combined UCV air (i.e. the first flow of clean air) and Coanda air (i.e. the second flow of clean air) towards the target clean area in the form of the air curtain.

The second flow of clean air (i.e. Coanda air) may be created by either the first clean air means or, alternatively, by a second, independent clean air means. In embodiments where a second clean air means is present, it may comprise a separate air filter through which unclean air may be passed in order to create the second (i.e. Coanda) flow of clean air. The separate air filter may be a High-Efficiency Particulate Air (HEPA) type, but again the skilled person will appreciate that others are available and could be used.

The apparatus may comprise feed means for feeding the second flow of clean air to at least adjacent the Coanda effect device, and preferably the profiled convex surface thereof, where it entrains the first flow of clean air. The feed means may feed the second flow of clean air into the Coanda effect device. The Coanda effect device may comprise at least one aperture through which the second flow of clean air may pass into a plenum chamber, which plenum chamber is created at least adjacent the profiled convex surface. The plenum chamber may be created between the profiled convex surface and the clean air means.

The plenum chamber may comprise a wall, which extends towards, but is spaced apart from, the profiled convex surface, by a gap or slot through which the second flow of clean air is passed upon application of air pressure to the plenum chamber. The gap may be between 0.5 and 3 mm in diameter, or between 1 mm and 2 mm in diameter or height. Preferably, the wall comprises a profiled concave surface. In one embodiment, the slot through which second flow of clean air passes may be disposed on the internal side of the apparatus. In another embodiment, the slot through which second flow of clean air passes may be disposed on the external side of the apparatus.

Accordingly, upon application of pressure to the plenum chamber, the second (i.e. Coanda) flow of clean air is blown through the slot where it entrains and combines with the first (i.e. UCV) flow of clean air. Advantageously, the inventors have observed that providing the second flow of clean air, which is directed towards the inner side of the profiled concave surface, surprisingly enhances the influence of the Coanda principal, as the second flow of clean air moves down and passed the lower edge of the concave surface through the gap at which point it mixes with the first flow of clean air discharged through the outlet. The two flows of clean air move passed the profiled convex surface, and then outwards collectively creating the air curtain, thereby preventing entrainment of unfiltered air.

All of the features described herein (including any accompanying claims, abstract and drawings), and/or all of the steps of any method or process so disclosed, may be combined with any of the above aspects in any combination, except combinations where at least some of such features and/or steps are mutually exclusive.

For a better understanding of the invention, and to show how embodiments of the same may be carried into effect, reference will now be made, by way of example, to the accompanying diagrammatic drawings, in which.

EXAMPLES

Figure 1:
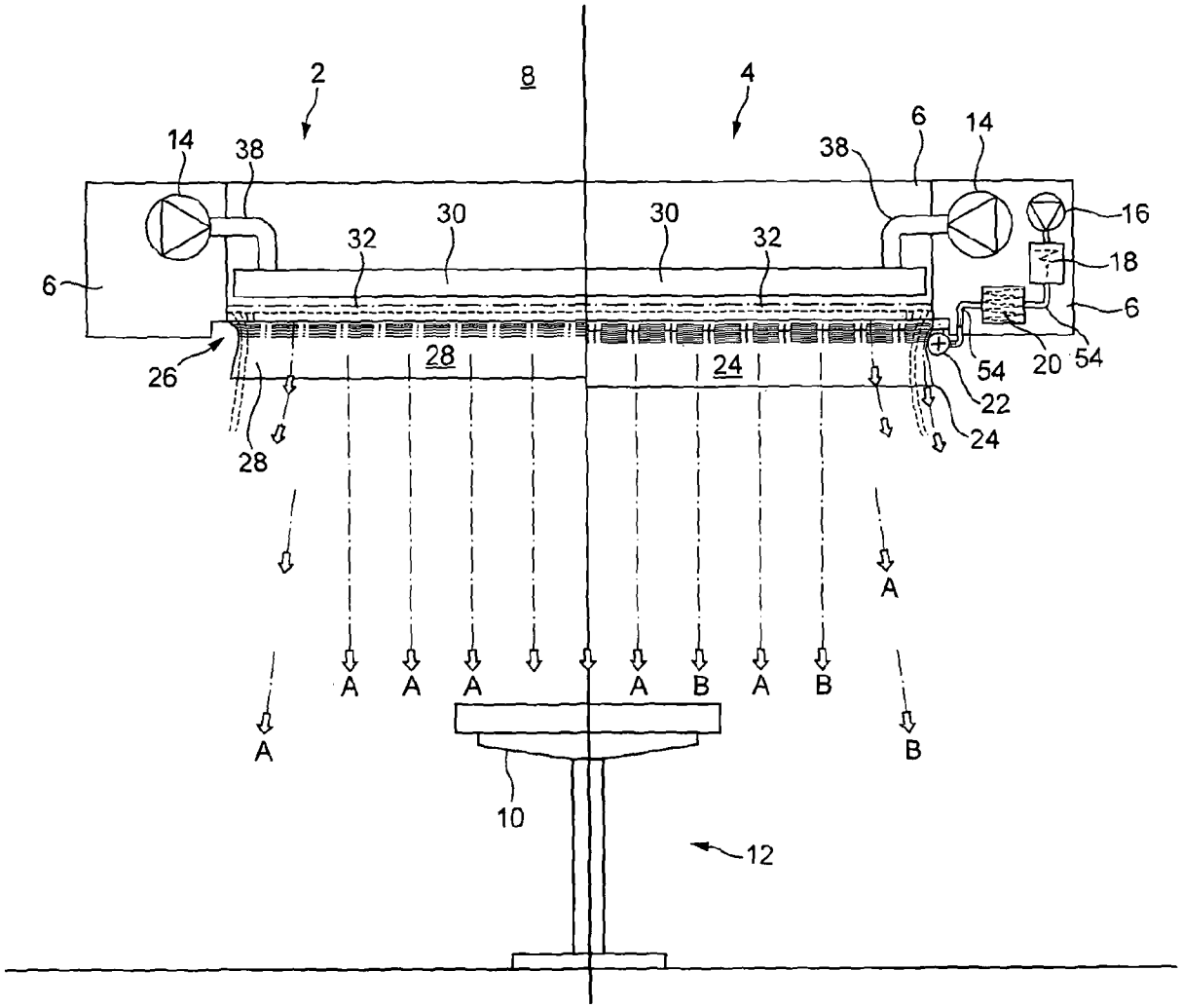
FIG. 1 is a cross-sectional side view of first and second embodiments of a clean air apparatus in accordance with the invention. On the left-hand side, there is shown an embodiment of a passive Coanda effect apparatus, and on the right-hand side, there is shown an embodiment of an active Coanda effect apparatus.

Referring to FIG. 1, there are shown first and second embodiments of a clean air apparatus 2, 4. For the avoidance of doubt, apparatus 2, 4 correspond to the same Ultra Clean Ventilation [UCV] system 6 which is secured to a ceiling 8 above a target clean area 12. The apparatus 2, 4 can be used in any environment or room where there is a need to create a "clean air" environment, for example over an operating table 10 in an operating theatre, or in a pharmaceutical or semiconductor manufacturing plant over the location where the pharmaceutical ingredients or semiconductor components are mixed together.

The first embodiment of the apparatus 2, shown on the left-hand side of the Figure, creates a passive Coanda effect around the periphery of the clean area 12, and the second embodiment of the apparatus 4, shown on the right-hand side of the Figure, creates an active Coanda effect around the periphery of the clean area 12, both for the purpose of providing an enhanced air curtain to replace partial walls, and each of these will now be described in detail.

Example 1

Passive Coanda System—First Embodiment (2)

With reference to FIG. 1 (left-hand side), the apparatus 2 includes a generally rectangular housing 6, which can be attached to the ceiling 8, and which effectively forms a canopy over the target clean area 12. Unfiltered air is initially supplied by a fan 14 disposed in the housing 6, and then passed through a conduit 38 to a filter assembly 30, being a High-Efficiency Particulate Air (HEPA) filter bank, which produces clean, filtered air, represented by arrows labelled 'A'. This clean air 'A' is then discharged into the clean area 12, through an outlet diffuser 32 having a series of perforations 33, in the form of a generally downwardly-directed current of air. In a hospital operating theatre, the filter assembly 30 and diffuser 32 together form the clean air unit of a hospital operating theatre Ultra Clean Ventilation [UCV] system, which is mounted on the ceiling 8. As shown in FIG. 1, the outlet diffuser 32 delivers air 'A', which is now clean, as an air volume into the operating zone 12 below across the entire area underneath the filter bank 30 and diffuser 32.

Figure 2:
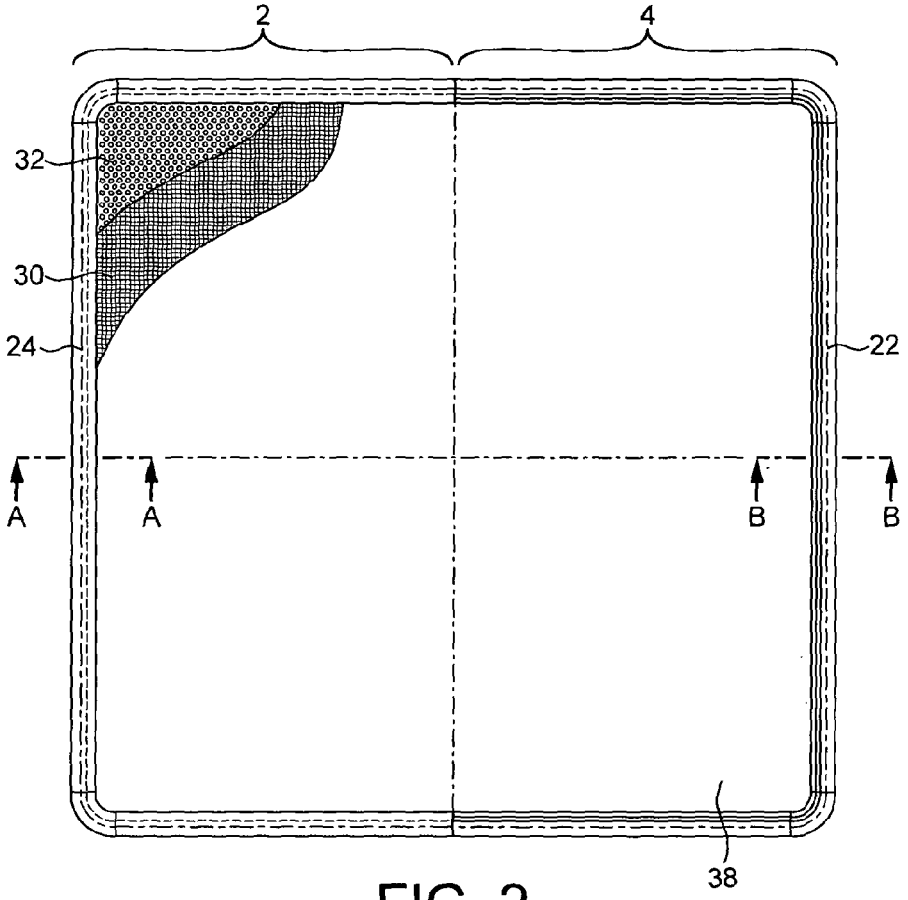
FIG. 2 is an inverted plan view of the two embodiments of the clean air apparatus shown in FIG. 1, with the passive Coanda apparatus represented in the left-hand side, and the active Coanda apparatus shown on the right-hand side.
Figure 3:
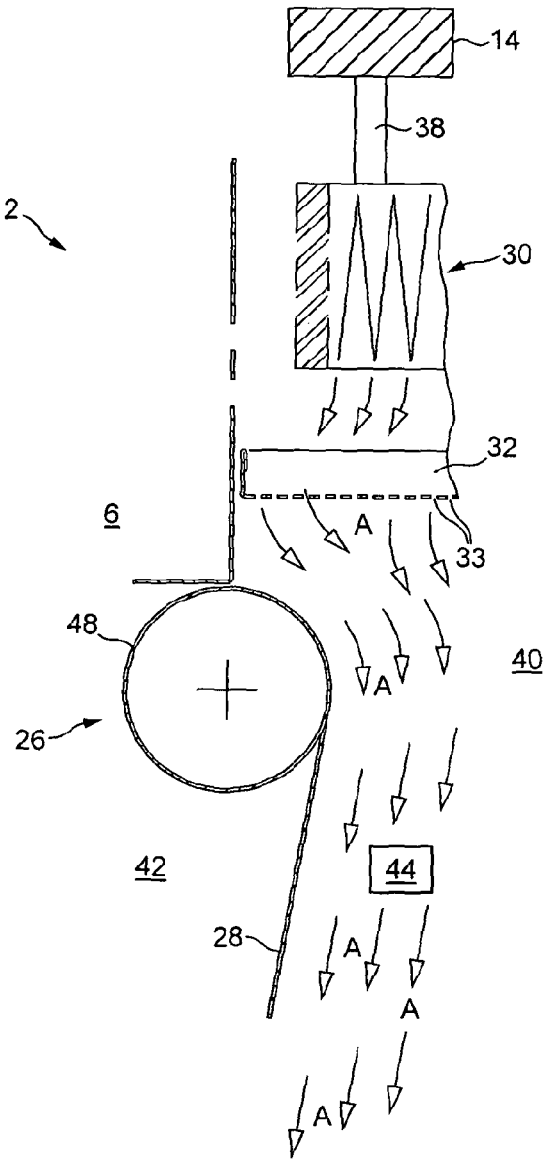
FIG. 3 is an enlarged cross-sectional side view of the passive Coanda effect apparatus shown in FIG. 1.

As shown on the left-hand side of FIG. 2, towards the periphery of each side of the housing 6, there is provided a passive Coanda effect device 26, which is shown in more detail in FIG. 3. The Coanda effect device 26 consists of a circular tube 48 secured to the underside of a corner of the housing 38, and is disposed so that it is partially positioned below the housing 38, and partially positioned below the clean air diffuser 32. This arrangement is important so that a quarter of the curved outer surface of the tube 48 is presented to the flow of clean air 'A', which is discharged through the diffuser 32. This curved surface is required for creating a passive "Coanda effect", i.e. no fan is required, and the air flow is created externally, for example by the UCV.

An external guide vane 28 is attached to the underside of the curved surface of the tube 48 at a position which is below the clean air diffuser 32, and is referred to as an internal 40 position. The vane 28 extends tangentially away from the tube 48, in a downwards and outwards direction at the periphery of the clean air area 12. The vane 28 extends at an angle of about 10° with respect to the vertical plane of the tube 48. In the embodiment of the passive Coanda effect device 26 shown in FIG. 1, the circular tube 48 and guide vane 28 assembly is constructed as a one-piece fabrication instead of using a tube 48 profile, because only a quarter of the curved surface is actually required for creating the passive Coanda effect, with the rest of the circumference of the tube 48 not necessarily being required.

As the clean air 'A' is discharged out of the perforations 33 of the diffuser 32, it is then passed over the Coanda effect devices 26, where it initially exhibits "attachment" to the curved surface of the tube 48 radius profile, in a process known as the passive "Coanda effect". Upon reaching the external guide vane 28, the clean air 'A' is then directed into the clean air area 12 where, due to the passive "Coanda effect", it exhibits an apparent increase of air movement that provides a greater impetus to the entire peripheral air in a manner similar to that of an air curtain. In other words, the outer periphery of the clean air area 12 involves air travelling at an increased speed compared to that of the clean air inside the area 12. This air curtain effect prevents the unwanted entrainment of surrounding unfiltered air into the clean zone 12, thereby avoiding the risk of contamination.

Example 2

Active Coanda System—Second Embodiment (4)

With reference to FIG. 1 (right-hand side), as with the passive Coanda effect apparatus 2, the active Coanda effect apparatus 4 includes a generally rectangular housing or canopy 6, which is attached to the ceiling 8, and which effectively forms is suspended over the target clean area 12. Unlike the passive Coanda effect apparatus 2, which has just a single source of clean air 'A' to create a passive Coanda effect, the active Coanda effect apparatus 4 involves the provision of two sources of clean air 'A' and 'B', which together combine to create an active Coanda effect and air curtain around the clean air area 12. The first source of clean air 'A' is created as follows.

Unfiltered air is initially supplied by fan 14, and passed through a conduit 38 to a filter assembly 30, such as a HEPA filter bank, which produces clean, filtered air, represented by the arrows labelled 'A'. This clean air 'A' is then discharged into the clean area 12, through a perforated outlet diffuser 32 forming a generally downwardly-directed current of air.

The second source of clean air 46, which is represented by the arrows labelled 'B', is initially supplied by a second fan 16 also disposed within the housing 6 and spaced apart from, and unconnected to, fan 14. Air from the second fan 16 may firstly be passed though a sound attenuator 18, then through a HEPA filter 20, and finally via a conduit 54 to an active Coanda effect device 22, which is provided towards the periphery of each side of the housing 6, as shown clearly on the right-hand side of FIG. 2. The structure of each active Coanda effect device 22 is shown in more detail in FIGS. 4 and 5. They consist of a circular tube 48 (or simply a curved quarter thereof), which is secured to the underside of a corner of the housing 6 by a duct section 60, which creates a plenum 52 therebetween. The plenum 52 is a chamber intended to contain air at positive pressure, due to fan 16, via a series of apertures 50, positioned at intervals along the complete length of tube 48, which ensure even distribution of clean air 'B' into the duct section 60.

Figure 4:
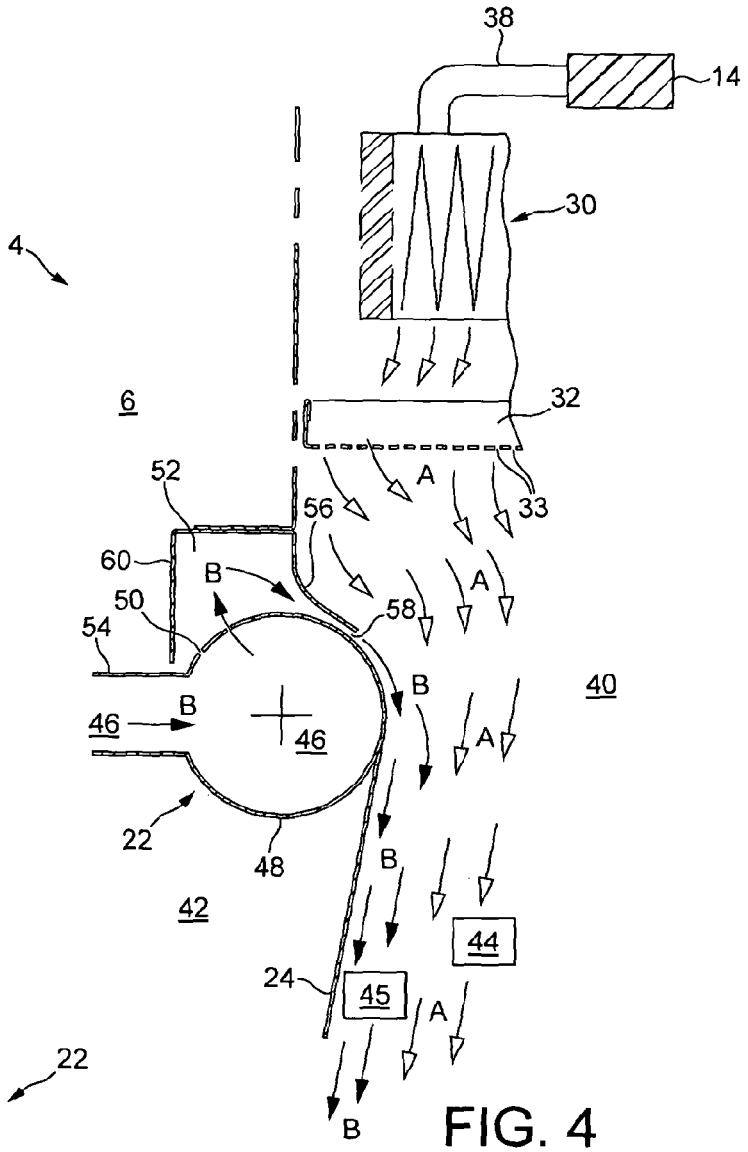
FIG. 4 is an enlarged cross-sectional side view of the active Coanda effect (with internal blowing) apparatus shown in FIG. 1.

As shown in FIG. 4, an inner wall of the duct section 60 to which the tube 48 is attached is curved (i.e. convex with respect to inside the plenum), and creates a first guide vane 56, which is curved and extends towards the curved upper profile of the tube 48. The first guide vane 56 makes nominal contact with the tube 48, and, at space apart intervals, leaves a longitudinal slot 58 of approximately 1.5 mm therebetween, and through which clean air 'B' may pass. The active Coanda effect device 22 also includes a second guide vane 28 attached to the underside of the curved surface of the tube 48 at a position which is below the clean air diffuser 32, and which is referred to as the internal 40 side of the apparatus or canopy 4.

The second guide vane 28 extends tangentially away from the tube 48, in a downwards and outwards direction into the clean air area 12. The vane 28 extends at an angle of about 10° with respect to the vertical plane of the tube 48. In another embodiment (not shown), the circular tube 48 and guide vane 28 assembly of the active Coanda effect device 22 can be constructed as a one-piece fabrication instead of using a tube, as only a quarter of the curved surface is required for creating the active Coanda effect, which will now be described.

As the clean air 'A' is discharged out of the perforations 33 of the diffuser 32, it passes initially over the concave surface of the first guide vane 56, and then towards the curved surface of the tube 48 where it exhibits 'attachment' to the surface of the tube 48 radius profile creating a "Coanda effect" in a 'passive' manner, in a way similar to that of the first embodiment of the apparatus 2 described above. However, as soon as the clean air 'A' leaves the lowermost edge of the first guide vane 56, the air 'A' is accelerated downwards as it is drawn into a jet 45 of clean air 'B' that exits the plenum 52 created between the duct section 60 and the tube 48 via the longitudinal slot 58, and this becomes the 'active' part of the "Coanda" device 22. As the clean air 'B' continues to flow, by the Coanda effect, around the tube 48 radius profile, it moves onto the second guide vane 24, which is fastened to the rear of the tube 48 surface and first guide vane 56, and it maintains its attachment to the first guide vane 56 due to it being concave shaped. As this externally blown air 'B' then passes the lower edge of the second guide vane 24, it does so in an accelerated manner and influences the internal clean air 'A' to move with it in a downward direction into the periphery of the clean air area 12, but not entering it, and therefore creates an air curtain. Accordingly, the effects of entrainment of surrounding unfiltered air into the clean air area 12 are nullified, because they are more forcefully controlled.

The 'active' means of the 'Coanda' device 24 in the second embodiment of the apparatus 4 is the second fan system 16, which is separate from that of the rest of the canopy 6, that feeds air 'B' directly into the duct 60 part of the tube 48 assembly via the sound attenuator 18 and filter 20. This embodiment of the active Coanda system is known as an internal blowing device, because the Coanda air 'B' is blown towards the internal side 44 of the apparatus or canopy 4, as shown in FIG. 4.

Figure 5:
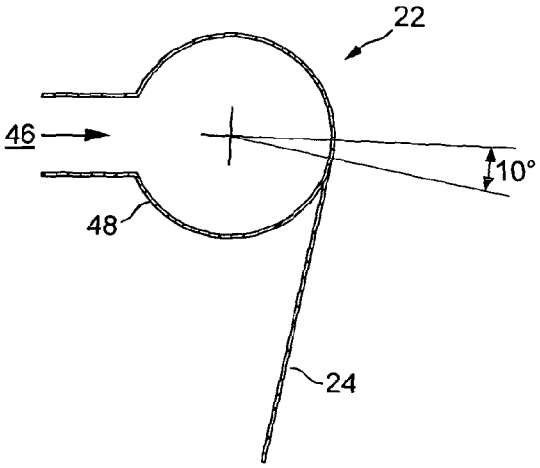
FIG. 5 is an enlarged cross-sectional side view of the active Coanda effect apparatus shown in FIG. 4 illustrating the angle of a guide vane.

Referring now to FIG. 5, there is shown a simplified representation of the active Coanda effect device 22 of shown in FIG. 4 showing the tube 48 and the second guide vane 24, though the same arrangement can apply to the passive Coanda effect device 26 shown in FIG. 3. As can be seen, the guide vane 24 extends tangentially downwards from the internal side 44 of the tube 48 and outwards at the periphery of the clean zone at an angle of about 10° from the vertical plane. However, it should also be appreciated that the vane 24 can, in other embodiments, extend from the tube 48 at other angles depending on the size of the apparatus 4, and the corresponding clean area 12 that it is suspended above. For example, the angle can be between about 20-30°.

It will be appreciated that instead of attaching the apparatus 2, 4 to the ceiling 8, it may be secured to a wall (not shown), for example of an operating theatre, in which case the Coanda effect devices 22, 26 are provided on the three remaining sides, since no outward flow of air is possible along the fourth side attached to the wall, due to the presence of the wall itself.

Example 3

Active Coanda System—Third Embodiment (70)

Figure 6:
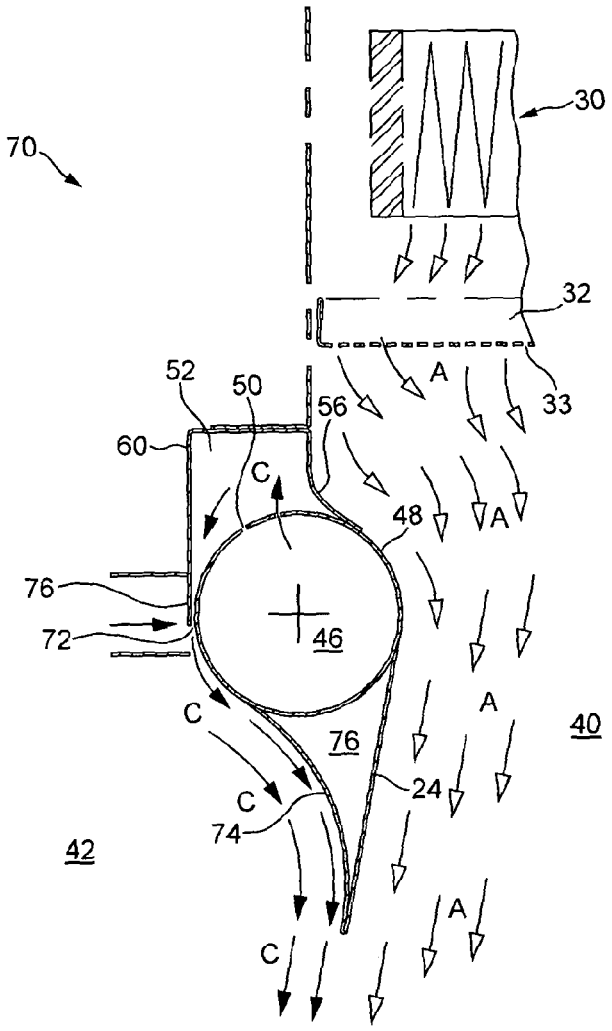
FIG. 6 is an enlarged cross-sectional side view of a third embodiment of the clean air apparatus (i.e. active Coanda with external blowing).

Referring now to FIG. 6, there is shown a third embodiment of the clean air apparatus 70, which is also an active Coanda system. However, unlike the active Coanda embodiment shown in FIG. 4, the embodiment shown in FIG. 6 is known as an external blowing device, because Coanda air 'C' is blown towards the external side 42 of the apparatus or canopy 70, rather than the internal side 44. This is achieved by sealing the first guide vane 56 along the tube 48 such that there is no longitudinal slot 58 (as in the second embodiment) on the internal side 44 of the tube 48, and by creating a corresponding slot 72 on the external side 42 of the Coanda tube 48 instead. The external slot 72 is formed between a flange section 76 of the duct 60 which extends towards the external side 42 of the circumference of tube 48. As can be seen in FIG. 6, in addition to the second guide vane 24, there is also provided a concave shaped surface 74 which extends from the underside of tube 48 down to the lowermost part of guide vane 24 to create an aerofoil or wing 76.

In use, as with the second embodiment, the clean air supply 46 enters tube 48, and then enters the plenum 52 via apertures 50. The clean air, now shown as arrows 'C', passes through slot 72 formed between flange 72 and tube 48 around the external side 42 of the canopy, and then along and down the external concave surface 74 of aerofoil 76. Also as with the second embodiment 4, clean air 'A' is discharged out of the perforations 33 of the diffuser 32, and passes over the concave surface of the first guide vane 56. It then moves towards the curved surface of the tube 48 where it exhibits 'attachment' to the surface of the tube 48 radius profile creating a "Coanda effect" in a 'passive' manner, in a way similar to that of the first and second embodiments of the apparatus 2, 4. The clean air 'A' leaves the lowermost edge of the first guide vane 56, and around the side of the second guide vane 24. However, as the air 'A' reaches the lowermost point of the guide vane 24, the air 'A' is accelerated downwards as it is drawn into the jet of clean air 'C' that passes along the external side 42 of the aerofoil 76. Thus, as air 'B' passes the lower edge of the aerofoil 76, it does so in an accelerated manner and thereby influences the internal clean air 'A' to move with it in a downward direction into the periphery of the clean air area 12, but not entering it, and therefore creates an air curtain.

In another embodiment (not shown), the clean air apparatus can be both an internal and an external blowing device in which there are provided both the internal slot 58 and the external slot 76. In this embodiment, air 'B' and 'C' flows blow from both faces (internal and external) of the Coanda tube 48, thereby accelerating the flow of clean air 'A'.

SUMMARY

The first embodiment of the apparatus 2, shown on the left-hand side of FIGS. 1 and 2, creates a passive Coanda effect at the periphery of the clean area 12, and relies completely on the canopy 6 airflow to provide a Coanda type effect by using the assembly of the curved folded surface of the tube 48 with the guide vane 28. The second embodiment of the apparatus 4, shown on the right-hand side of the FIGS. 1 and 2, creates an active Coanda effect (internal blowing) at the periphery of the clean area 12, which involves positively generated air movement via a separate fan 16 with a sound attenuator 18 (if required), HEPA filter 20 and conveying duct sections 60 within the boundaries of the canopy 6. the third embodiment 70 creates an external blowing active Coanda.

Normally the use of a Coanda effect would be to influence air movement passing by the blowing outlet, i.e. upstream of the apparatus. However, in the present active Coanda effect apparatus 4, blowing Coanda air at the rear side of the first guide vane 56, with the guide 56 being shaped as an aerofoil towards its rear, as opposed to straight at the internal face, serves to enhance the influence of the Coanda principal, as its air moves on down and passed the lower edge of the vane 56 and through slot 58. This is where clean air 'B' will pick up clean air 'A' discharged through the diffuser 32, and "escort" it down to the lower level, while allowing it to move ultimately outwards at a point to prevent entrainment of unfiltered air.

The provision of the guide vanes 24, 28, which extend downwardly and tangentially away from the curved outer circumference of the tube 48 serve to produce a curtain of filtered air around the target area 12, and therefore prevent unfiltered air from becoming entrained, thereby causing contamination.

The invention claimed is:

1. A clean air apparatus comprising:

a housing configured to be attached to a ceiling and thereby define a canopy over a target clean area, a fan and a filter disposed in the housing, wherein the fan is configured to blow unclean air through the filter to create a flow of clean air and for discharging the clean air from an outlet and towards the target clean area, wherein the outlet comprises a diffuser, through which the flow of clean air is discharged towards the target clean area, a Coanda effect device comprising a profiled convex surface, which forms at least a quarter portion of a circle, along which the flow of clean air passes, wherein the Coanda effect device is disposed at least adjacent and around all of a periphery of the outlet and arranged, in use, to induce a Coanda effect upon the flow of clean air, and a guide comprising a substantially planar guide vane which is at least 2 cm in length, and is attached to and disposed downstream of the Coanda effect device such that, when the housing is attached to the ceiling, the guide vane extends in a downwards direction from an inner or internal side of the Coanda effect device, where it is attached to the Coanda effect device, to an outer or external side thereof and configured to guide the clean air towards the target clean area in the form of an air curtain around all of a periphery of the target clean area.

2. The apparatus according to claim 1, wherein the apparatus is incorporated into a hospital's ultra clean ventilation (UCV) system, or is used in a manufacturing plant of a pharmaceutical product or a semiconductor.

3. The apparatus according to claim 1, wherein the profiled convex surface comprises or forms at least half of the circumference of a circle.

4. The apparatus according to claim 1, wherein the Coanda effect device is disposed so that, in use, it is at least partially below the outlet, thereby presenting the profiled convex surface to the flow of clean air discharged from the outlet.

5. The apparatus according to claim 1, wherein the guide extends tangentially away from the profiled convex surface at an angle of between 1° and 30° with respect to a vertical plane of the Coanda effect device.

6. The apparatus according to claim 1, wherein the Coanda effect device is an internal blowing device in which the flow of clean air is blown towards an internal side of the apparatus or canopy and/or wherein the Coanda effect device is an external blowing device in which the flow of clean air is blown towards an external side of the apparatus or canopy.

7. The apparatus according to claim 1, wherein the Coanda effect device is arranged to feed a second flow of clean air, which is passed over the profiled convex surface, such that it entrains the first flow of clean air, wherein the two flows of clean air are collectively discharged around the periphery of the target clean area, and wherein the second flow of clean air is created by either the fan and the filter or, alternatively, by a second, independent fan and filter.

8. The apparatus according to claim 7, wherein the apparatus comprises a feeder feeding the second flow of clean air to at least adjacent the Coanda effect device and the profiled convex surface thereof, where it entrains the first flow of clean air.

9. The apparatus according to claim 7, wherein the Coanda effect device comprises at least one aperture through which the second flow of clean air passes into a plenum chamber, which plenum chamber is created at least adjacent the profiled convex surface.

10. The apparatus according to claim 9, wherein the plenum chamber comprises a wall, which extends towards, but is spaced apart from, the profiled convex surface, by a gap or slot through which the second flow of clean air is passed upon application of air pressure to the plenum chamber.

11. The apparatus according to claim 10, wherein the wall comprises a profiled concave surface.

12. The apparatus according to claim 10, wherein the slot through which the second flow of clean air passes is disposed on an internal or external side of the apparatus.

13. The apparatus according to claim 1, wherein the apparatus is incorporated into a hospital ultra clean ventilation (UCV) system.

14. The apparatus according to claim 1, wherein the apparatus is incorporated into a pharmaceutical manufacturing plant ventilation system.

15. The apparatus according to claim 1, wherein the apparatus is incorporated into a semiconductor manufacturing plant ventilation system.

16. The apparatus according to claim 1, wherein the profiled convex surface comprises or forms substantially all of the circumference of a circle.

17. A method for discharging clean air towards a target clean area in the form of an air curtain, the method comprising:

(i) creating a flow of clean air by a fan and a filter, wherein the fan is configured to blow unclean air through the filter and the fan and the filter are disposed in a housing which is attached to a ceiling and defines a canopy over a target clean area;

(ii) discharging the flow of clean air through an outlet, wherein the outlet comprises a diffuser, through which the flow of clean air is discharged towards the target clean area;

(iii) inducing a Coanda effect upon the flow of clean air using a Coanda effect device comprising a profiled convex surface, which forms at least a quarter portion of a circle, along which the flow of clean air passes, wherein the Coanda effect device is disposed at least adjacent and around all of a periphery of the outlet; and (iv) guiding the discharged clean air along a substantially planar guide vane, attached to and disposed downstream of the Coanda effect device, towards the target clean area in the form of an air curtain, wherein the guide vane is at least 2 cm in length, extends in a downwards direction from an inner or internal side of the canopy, where it is attached to the Coanda effect device, to an outer or external side thereof, such that the clean air is guided towards the target clean area in the form of an air curtain around all of a periphery of the target clean area.

18. The method according to claim 17, wherein the guide vane extends tangentially away from the profiled convex surface at an angle of between 1° and 30° with respect to a vertical plane of the Coanda effect device.

* * * * *